US010850328B1

(12) United States Patent
Cui et al.

(10) Patent No.: US 10,850,328 B1
(45) Date of Patent: Dec. 1, 2020

(54) METHOD OF MAKING IRON MATRIX COMPOSITE

(71) Applicant: Southwest Jiaotong University, Chengdu (CN)

(72) Inventors: Guodong Cui, Chengdu (CN); Yuxuan Liu, Chengdu (CN); Chengsong Zhang, Chengdu (CN); Yifei Chen, Chengdu (CN); Qin Xu, Chengdu (CN)

(73) Assignee: SOUTHWEST JIAOTONG UNIVERSITY, Chengdu (CN)

( * ) Notice: Subject to any disclaimer, the term of this patent is extended or adjusted under 35 U.S.C. 154(b) by 0 days.

(21) Appl. No.: 16/883,234

(22) Filed: May 26, 2020

(30) Foreign Application Priority Data

May 27, 2019 (CN) ..... 2019 1 0446496

(51) Int. Cl.
*B22F 3/16* (2006.01)
*B22F 3/105* (2006.01)
*B22F 3/10* (2006.01)

(52) U.S. Cl.
CPC ..... *B22F 3/162* (2013.01); *B22F 3/1007* (2013.01); *B22F 2003/1051* (2013.01); *B22F 2301/15* (2013.01); *B22F 2301/35* (2013.01); *B22F 2302/45* (2013.01); *B22F 2304/10* (2013.01)

(58) Field of Classification Search
CPC .. B22F 3/004; B22F 3/16; B22F 3/162; B22F 3/105; B22F 3/1007; B22F 2003/1051; B22F 2201/20; B22F 2301/15; B22F 2301/35; B22F 2302/20; B22F 2302/35; B22F 2302/45; B22F 2304/056; B22F 2304/10; B22F 2998/00; B22F 2998/10; B22F 2999/00
See application file for complete search history.

(56) References Cited

FOREIGN PATENT DOCUMENTS

| | | | |
|---|---|---|---|
| CN | 103131928 | | 6/2013 |
| CN | 107190206 | | 9/2017 |
| CN | 107336483 | A * | 11/2017 |
| CN | 108526467 | | 9/2018 |
| JP | 06-29436 | | 2/1994 |
| JP | 2012091975 | A * | 5/2012 |

OTHER PUBLICATIONS

Office Action dated Nov. 5, 2019 in corresponding Chinese Patent Application No. 201910446496.8 with, English translation.

* cited by examiner

*Primary Examiner* — Vanessa T. Luk
(74) *Attorney, Agent, or Firm* — Wenderoth, Lind & Ponack, L.L.P.

(57) ABSTRACT

The disclosure provides a method of making an iron matrix composite. A Fe—Ni—P composite powder having a particle size of one to two micrometers and a Fe—N powder having a particle size of 100 to 250 nanometers are used as the raw material. The size and axial displacement of pressing heads of a graphite mold are controlled to realize the control of the porosity of porous iron. The composite produced comprises two surface layers of a Fe—Ni—P alloy and an intermediate layer of porous iron having a porosity of 14 to 39%. The method enables a reduced weight of the Fe—Ni—P alloy and enables shock absorption and damping properties to be imparted to the composite. In addition, an optional subsequent deep cryogenic treatment allows the Fe—Ni—P alloy to be subjected to phase transition from a metastable gamma-phase to an alpha-phase, thereby substantially improving the hardness and strength thereof.

6 Claims, 2 Drawing Sheets

METHOD OF MAKING IRON MATRIX COMPOSITE

FIELD OF THE INVENTION

The present disclosure generally relates to metal matrix composites and advanced making.

BACKGROUND OF THE INVENTION

Metal matrix composite materials or metal matrix composites have always been driving toward light weight, high strength, and multi-function. Such materials, having been developed in recent years, have a sandwich structure having dense surface layers and a porous intermediate layer disposed therebetween. The dense structure of the surface layers allows excellent mechanical properties of the conventional metal materials to be retained, and the porosity of the intermediate layer enables a reduced material density and also enables shock absorption, noise reduction, and damping properties to be imparted to the composite materials. The metal matrix composites having such composite structure have applications in many fields with a huge market potential, such as mechanical engineering, aerospace, automobile, and high-speed trains.

CN 103131928A describes a method of making an iron alloy of a micro- and nano-scale porous structure by using a Fe—N alloy powder as the raw material and controlling its phase transformation behavior during a sintering process. This method is conducted in the absence of a foaming agent or a pore-forming agent. The produced iron alloy has excellent mechanical properties, but a low surface hardness and a poor corrosion resistance. Due to the disadvantages, application of the iron alloy in the production of various parts, such as gears and bearings, having shock absorption and damping properties is limited.

Fe—Ni—P alloys are a class of high-performance alloys having high phosphorus content, which are newly developed in recent years through powder metallurgy techniques (CN 107190206 A). Such alloys have excellent mechanical properties and corrosion resistance, and could be used in place of stainless steel powder metallurgy products for the production of various highly sophisticated parts such as gears and bearings. However, due to the relatively high cost of the Fe—Ni—P composite powder and the waste liquid discharge which adversely affects the environment, development and application of the alloys is limited.

In view of the above problems and in order to combine advantageous features of both the Fe—N powder and the Fe—Ni—P composite powder, aspects of the disclosure provide a method of making an iron matrix composite. The composite produced by the method has a sandwich structure having two surface layers of a Fe—Ni—P alloy and an intermediate layer of porous iron disposed therebetween. Compared with the Fe—Ni—P alloy materials as described above, the Fe—Ni—P alloy of the disclosed composite is only present in the surface layers thereof, thereby substantially reducing the amount of the Fe—Ni—P composite powder used and thus the cost and environment pollution. Further, hardness, strength, and corrosion resistance of the surface layers of the composite are the same as those of the monolithic Fe—Ni—P alloy materials. The porous iron intermediate layer allows for a substantially reduced weight of the composite and also enables shock absorption and damping properties to be imparted thereto.

SUMMARY OF THE INVENTION

An objective of the present disclosure is to provide a method of making an iron matrix composite, which enables a combination of advantageous features of the Fe—Ni—P alloy materials and porous iron. The composite produced by the method has a sandwich structure having two surface layers of a Fe—Ni—P alloy and an intermediate layer of porous iron disposed therebetween, and has excellent comprehensive properties. So, the present disclosure provides technical support for the production of various highly sophisticated parts having shock absorption and damping properties, such as gears and bearings.

The objective of the disclosure is realized by a method of making an iron matrix composite, comprising:

weighing two parts of a Fe—Ni—P composite powder with a particle size of about 1 micrometer to about 2 micrometers and one part of a Fe—N powder with a particle size of about 100 nanometers to about 250 nanometers, wherein each part of the Fe—Ni—P composite powder is about 15% to about 20% by weight of the total amount of the powder, and wherein the Fe—N powder is about 60% to about 70% by weight of the total amount of the powder; placing one of the two parts of the Fe—Ni—P composite powder, the one part of the Fe—N powder, and the other one of the two parts of the Fe—Ni—P composite powder in a graphite mold in sequence to be subjected to a pre-press forming process under an axial pressure of 20 MPa, so as to form a composite cylinder with two ends formed by the Fe—Ni—P composite powder and a middle section therebetween formed by the Fe—N powder; and placing the preformed cylinder along with the mold in a spark plasma sintering furnace to be sintered in a vacuum environment.

The axial pressure may be applied from two opposing directions. In particular, an upper pressing head may have an advance length of about 2 centimeters to about 3 centimeters inside the mold, and a lower pressing head may have an advance length of about one centimeter thereinside. During the sintering process, the upper and lower pressing heads positioned at either end of the mold may move toward each other in an axial direction until stop shoulders on the upper and lower pressing heads abut end surfaces of the two ends of the mold, such that a space of about 6.28 cubic centimeters to about 9.42 cubic centimeters is left in the mold cavity for free sintering and final forming of the powder and the resulting composite has an intermediate layer with a porosity of about 14% to about 39%.

The graphite mold may be in the form of a hollow cylinder.

Each of the upper and lower pressing heads may be T-shaped and in the form of a cylinder with a stop shoulder.

The Fe—Ni—P composite powder used has a particle size of about 1 micrometer to about 2 micrometers, and may have Ni and P contents of about 28% to about 30% and about 1.5% to about 2% by weight, respectively. The Fe—N powder used may have an N content of about 8% to about 10% by weight.

The sintering process may produce a Fe—Ni—P alloy having a metastable gamma-phase structure, i.e., a face-centered cubic structure.

The sintering process may be performed through heating the furnace up to a temperature of about 800° C. to about 875° C. at a temperature rising rate of about 100° C./min to about 200° C./min and holding at that temperature for about 1 minute to about 5 minutes.

The composite produced by the disclosed process comprises an intermediate layer of porous iron, which may have an average pore size of equal to or greater than about one micrometer and may provide shock absorbing and damping properties. The Fe—Ni—P alloy is disposed on either side of the intermediate layer and has high Ni and P contents.

The composite produced by the disclosed method comprises surface layers made of a Fe—Ni—P alloy, which may have a dense structure with a porosity of about 0% to about 10% and may have a metastable gamma-phase structure, i.e., a face-centered cubic (FCC) structure. Such Fe—Ni—P alloy may have excellent mechanical properties and corrosion resistance. Deformation of the alloy under the application of a force or a lower temperature may induce phase transition from the gamma-phase to an alpha-phase (i.e., body-centered cubic (BCC) structure). This transition yields significantly improved hardness and yield strength of the alloy. In addition, the porosity of the intermediate layer can significantly reduce the density of the sintered product and impart good shock absorption and damping properties thereto.

The disclosed method has several advantages as compared with the prior art.

Currently, porous materials are widely used as a functional material rather than a structural material. Although porous metals generally have superior mechanical properties, they could hardly meet the industry requirements. For example, conventional porous iron matrix materials have a high specific strength and excellent shock absorption and damping properties due to their porosity, but have poor wear and corrosion resistances, thereby greatly limiting their use as the material of key components. In contrast, the intermediate layer of the iron matrix composite of the disclosure has a porous structure, and the surface layers thereof have a dense structure. Such composite has excellent properties of the porous materials, and its surfaces have substantially improved wear and corrosion resistances. Further, the dense structure of the surface layers can improve the mechanical properties of the composite to some extent and makes it possible to be used as a structural material, particularly as the material of precision bearings, gears and the like which are suitably strong to withstand loadings and friction and need to have shock absorption and noise reduction properties.

In general, the mechanical properties of the porous materials decrease with an increase in the pore size. The micro- and nano-scale porosity of the intermediate layer of the disclosed composite has excellent mechanical properties as compared with conventional materials having macropores, such as aluminium foam and iron foam. In addition, unlike conventional production processes, the disclosed method does not require the use of any foaming agent or pore-forming agent and thus avoids possible contamination thereof. Rather, during the sintering, the powder could spontaneously decompose and release nitrogen which is harmless and may produce pores therein. So, the disclosed method is relatively simple and environmentally friendly.

The Fe—Ni—P alloy layers of the composite have excellent mechanical properties and corrosion resistance. Plastic deformation or deep cryogenic treatment may induce phase transition from the gamma-phase to an alpha-phase. This transition yields significantly improved hardness and yield strength of the alloy. Further, this transition can be controlled by varying external conditions, and the properties of the surface layers of the composite can be adjusted according to requirements by changing parameters such as temperature and duration of deep cryogenic treatment. This greatly avoids thermal shock which is unavoidable for conventional heat treatment, and cracking of the alloy can be prevented.

DETAILED DESCRIPTION

Example 1

Figure 1:
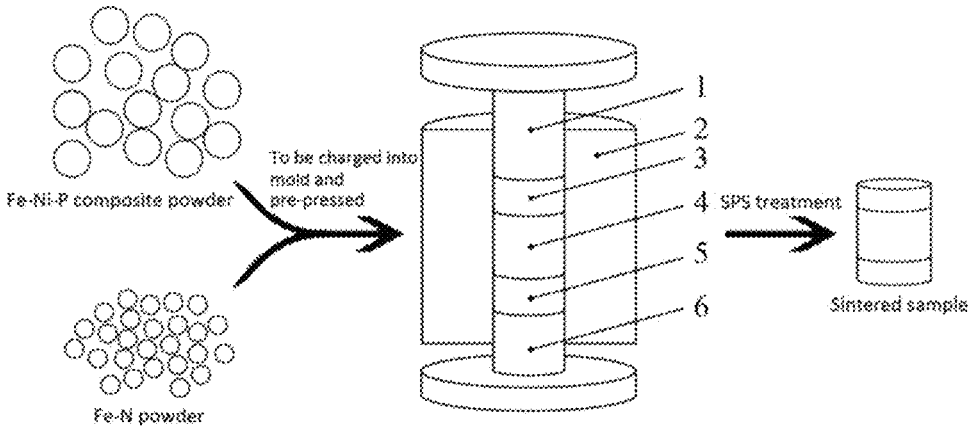
FIG. 1 is a flow chart of a method of one embodiment of the invention.
Figure 2:
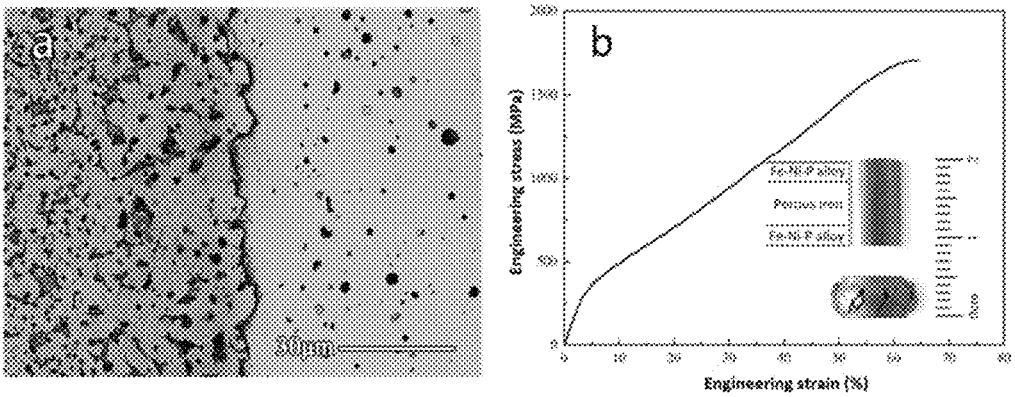
FIG. 2 shows a macroscopic topography of a composite comprising two surface layers of a Fe—Ni—P alloy and an intermediate layer of porous iron therebetween, produced according to the disclosed method, and a microscopic topography of a composite interface, as well as a compression stress-strain curve.
Figure 3:
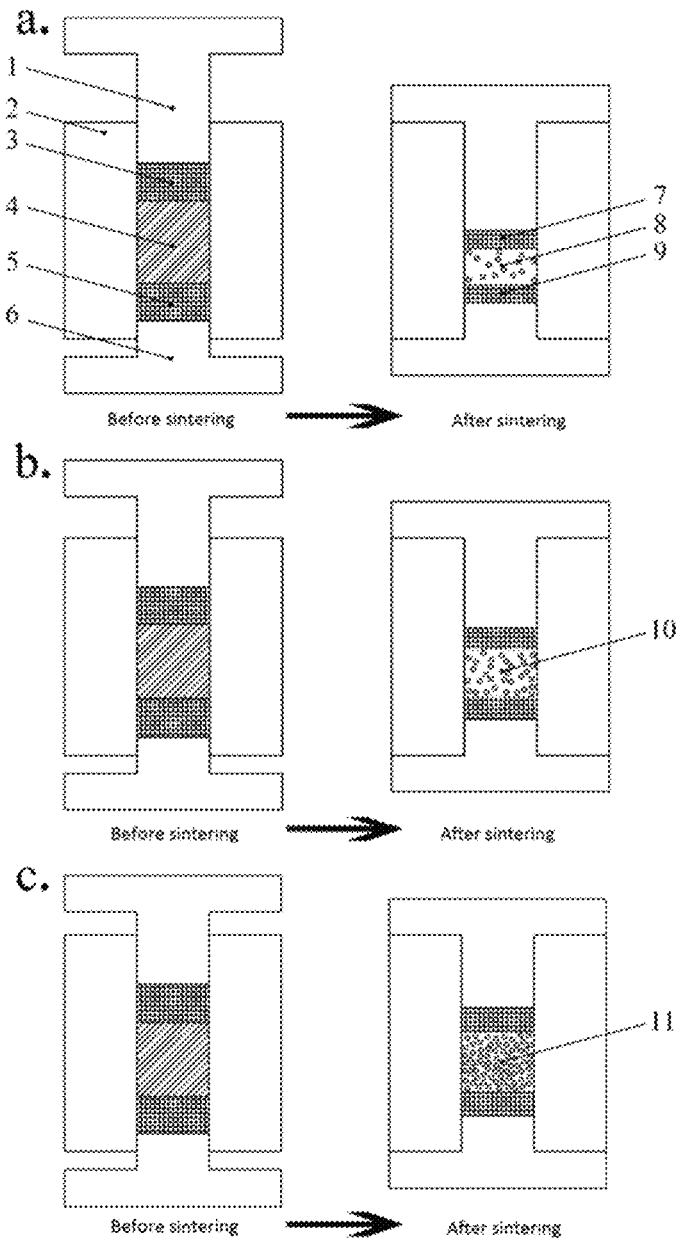
FIG. 3 is a schematic illustrating formation of the porous iron layer having a controllable porosity.

With reference to FIG. 3-*a*, two parts of a Fe—Ni—P composite powder 3, 5 were weighed and each part weighed 9 g, wherein the powder had an average particle size of one micrometer and had Ni and P contents of 28% and 1.5% by weight, respectively. 27 g of a Fe—N powder 4 was weighed, wherein the Fe—N powder 4 had an average particle size of 100 nanometers and had N content of 8% by weight. That is, the amounts of the Fe—Ni—P composite powder 3, 5 and the Fe—N powder 4 were 20%*2 and 60% of their total amount, respectively. 9 g of the Fe—Ni—P composite powder 5, 27 g of the Fe—N powder 4, and 9 g of the Fe—Ni—P composite powder 3 were placed in sequence in a graphite mold 2 with a diameter of 2 centimeters and a height of 6 centimeters. Lower and upper pressing heads 6, 1 were advanced by a distance of 1 centimeter and 3 centimeters, respectively, to perform a pre-press forming process so as to attain adequate contact between the powder particles. The powder along with the mold 2 was then placed in a furnace cavity to be sintered by using a spark plasma sintering (SPS) technique. An axial pressure of 20 MPa was applied to the powder inside the mold to fix it and then the furnace chamber was vacuumized. The furnace was heated to 875° C. at a rate of 100° C./min and was held at that temperature for 5 minutes. During this, the upper and lower pressing heads 1, 6 gradually moved toward each other with the proceeding of densifying the powder until inner sides of stop shoulders on the pressing heads 1, 6 abutted end surfaces of the mold. Thereafter, the powder was not subjected to the 20 MPa fixed pressure any more, but rather was subjected to free sintering and final forming in a fixed space. After the hold period, the heating was stopped, and the sintered powder was cooled to room temperature in a vacuum environment with circulating water along with the furnace. Then, the sample was removed from the furnace, and the graphite remaining thereon was removed to produce smooth surfaces. The resulting sample had an intermediate layer 8 of porous iron with a porosity of about 14% and a hardness of 170 HV0.1, and two surface layers 7, 9 of a Fe—Ni—P alloy with a porosity of close to 0% and a hardness of 250 HV0.1.

Example 2

Two parts of a Fe—Ni—P composite powder 3, 5 were weighed and each part weighed 8.68 g, wherein the powder had an average particle size of 1.17 micrometers and had Ni and P contents of 28.33% and 1.57% by weight, respectively. 27.9 g of a Fe—N powder 4 was weighed, wherein the Fe—N powder 4 had an average particle size of 125 nanometers and had N content of 8.33% by weight. That is, the amounts of the Fe—Ni—P composite powder 3, 5 and the Fe—N powder 4 were 19.16%*2 and 61.68% of their total amount, respectively. 8.68 g of the Fe—Ni—P composite powder 5, 27.9 g of the Fe—N powder 4, and 8.68 g of the Fe—Ni—P composite powder 3 were placed in sequence in a graphite mold 2 with a diameter of 2 centimeters and a height of 6 centimeters. Lower and upper pressing heads 6, 1 were advanced by a distance of 1 centimeter and 2.83 centimeters, respectively, to perform a pre-press forming process under an axial pressure of 20 MPa so as to attain adequate contact between the powder particles. The powder along with the mold 2 was then placed in a furnace cavity to be sintered by using a spark plasma sintering (SPS) technique. An axial pressure of 20 MPa was applied to the powder inside the mold to fix it and then furnace chamber was vacuumized. The furnace was heated to 862.5° C. at a rate of 117° C./min and was held at that temperature for 4.34 minutes. During this, the upper and lower pressing heads 1, 6 gradually moved toward each other with the proceeding of densifying the powder until inner sides of stop shoulders on the pressing heads 1, 6 abutted end surfaces of the mold. Thereafter, the powder was not subjected to the 20 MPa fixed pressure any more, but rather was subjected to free sintering and final forming in a fixed space. After the hold period, the heating was stopped, and the powder was cooled to room temperature in a vacuum environment with circulating water along with the furnace. Then, the sample was removed from the furnace, and the graphite remaining thereon was removed to produce smooth surfaces. The resulting sample had an intermediate layer 8 of porous iron with a porosity of about 18%, and two surface layers 7, 9 of a Fe—Ni—P alloy with a porosity of close to 0%.

Example 3

Two parts of a Fe—Ni—P composite powder 3, 5 were weighed and each part weighed 8.2 g, wherein the powder had an average particle size of 1.34 micrometers and had Ni and P contents of 28.66% and 1.64% by weight, respectively. 28.3 g of a Fe—N powder 4 was weighed, wherein the Fe—N powder 4 had an average particle size of 150 nanometers and had N content of 8.66% by weight. That is, the amounts of the Fe—Ni—P composite powder 3, 5 and the Fe—N powder 4 were 18.33%*2 and 63.34% of their total amount, respectively. 8.2 g of the Fe—Ni—P composite powder 5, 28.3 g of the Fe—N powder 4, and 8.2 g of the Fe—Ni—P composite powder 3 were placed in sequence in a graphite mold 2 with a diameter of 2 centimeters and a height of 6 centimeters. Lower and upper pressing heads 6, 1 were advanced by a distance of 1 centimeter and 2.66 centimeters, respectively, to perform a pre-press forming process under an axial pressure of 20 MPa so as to attain adequate contact between the powder particles. The powder along with the mold 2 was then placed in a furnace cavity to be sintered by using a spark plasma sintering (SPS) technique. An axial pressure of 20 MPa was applied to the powder inside the mold to fix it and then the furnace chamber was vacuumized. The furnace was heated to 850° C. at a rate of 134° C./min and was held at that temperature for 3.67 minutes. During this, the upper and lower pressing heads 1, 6 gradually moved toward each other with the proceeding of densifying the powder until inner sides of stop shoulders on the pressing heads 1, 6 abutted end surfaces of the mold. Thereafter, the powder was not subjected to the 20 MPa fixed pressure any more, but rather was subjected to free sintering and final forming in a fixed space. After the hold period, the heating was stopped, and the sintered powder was cooled to room temperature in a vacuum environment with circulating water along with the furnace. Then, the sample was removed from the furnace, and the graphite remaining thereon was removed to produce smooth surfaces. The resulting sample had an intermediate layer 10 of porous iron with a porosity of about 20%, and two surface layers 7, 9 of a Fe—Ni—P alloy with a porosity of about 10%.

Example 4

With reference to FIG. 3-*b*, two parts of a Fe—Ni—P composite powder 3, 5 were weighed and each part weighed 8.75 g, wherein the powder had an average particle size of 1.51 micrometers and had Ni and P contents of 29% and 1.71% by weight, respectively. 32.5 g of a Fe—N powder 4 was weighed, wherein the Fe—N powder 4 had an average particle size of 175 nanometers and had N content of 9% by weight. That is, the amounts of the Fe—Ni—P composite powder 3, 5 and the Fe—N powder 4 were 17.5%*2 and 65% of their total amount, respectively. 8.75 g of the Fe—Ni—P composite powder 5, 32.5 g of the Fe—N powder 4, and 8.75 g of the Fe—Ni—P composite powder 3 were placed in sequence in a graphite mold 2 with a diameter of 2 centimeters and a height of 6 centimeters. Lower and upper pressing heads 6, 1 were advanced by a distance of 1 centimeter and 2.5 centimeters, respectively, to perform a pre-press forming process under an axial pressure of 20 MPa so as to attain adequate contact between the powder particles. The powder along with the mold 2 was then placed in a furnace cavity to be sintered by using a spark plasma sintering (SPS) technique. An axial pressure of 20 MPa was applied to the powder inside the mold to fix it and then the furnace chamber was vacuumized. The furnace was heated to 837.5° C. at a rate of 150° C./min and was held at that temperature for 3 minutes. During this, the upper and lower pressing heads 1, 6 gradually moved toward each other with the proceeding of densifying the powder until inner sides of stop shoulders on the pressing heads 1, 6 abutted end surfaces of the mold. Thereafter, the powder was not subjected to the 20 MPa fixed pressure any more, but rather was subjected to free sintering and final forming in a fixed space. After the hold period, the heating was stopped, and the sintered powder was cooled to room temperature in a vacuum environment with circulating water along with the furnace. Then, the sample was removed from the furnace, and the graphite remaining thereon was removed to produce smooth surfaces. The resulting sample had an intermediate layer 10 of porous iron with a porosity of about 23%, and two surface layers 7, 9 of a Fe—Ni—P alloy with a porosity of about 10%.

Example 5

Two parts of a Fe—Ni—P composite powder 3, 5 were weighed and each part weighed 8.55 g, wherein the powder had an average particle size of 1.68 micrometers and had Ni and P contents of 29.33% and 1.78% by weight, respectively. 34.2 g of a Fe—N powder 4 was weighed, wherein the Fe—N powder 4 had an average particle size of 200 nanometers and had N content of 9.33% by weight. That is, the amounts of the Fe—Ni—P composite powder 3, 5 and the Fe—N powder 4 were 16.66%*2 and 66.68% of their total amount, respectively. 8.55 g of the Fe—Ni—P composite powder 5, 34.2 g of the Fe—N powder 4, and 8.55 g of the Fe—Ni—P composite powder 3 were placed in sequence in a graphite mold 2 with a diameter of 2 centimeters and a height of 6 centimeters. Lower and upper pressing heads 6, 1 were advanced by a distance of 1 centimeter and 2.33 centimeters, respectively, to perform a pre-press forming process under an axial pressure of 20 MPa so as to attain adequate contact between the powder particles. The powder along with the mold 2 was then placed in a furnace cavity to be sintered by using a spark plasma sintering (SPS) technique. An axial pressure of 20 MPa was applied to the powder inside the mold to fix it and then the furnace chamber was vacuumized. The furnace was heated to 825° C. at a rate of 167° C./min and was held at that temperature for 2.34 minutes. During this, the upper and lower pressing heads 1, 6 gradually moved toward each other with the proceeding of densifying the powder until inner sides of stop shoulders on the pressing heads 1, 6 abutted end surfaces of the mold. Thereafter, the powder was not subjected to the 20 MPa fixed pressure any more, but rather was subjected to free sintering and final forming in a fixed space. After the hold period, the heating was stopped, and the sintered powder was cooled to room temperature in a vacuum environment with circulating water along with the furnace. Then, the sample was removed from the furnace, and the graphite remaining thereon was removed to produce smooth surfaces. The resulting sample had an intermediate layer 10 of porous iron with a porosity of about 27%, and two surface layers 7, 9 of a Fe—Ni—P alloy with a porosity of about 10%.

Example 6

Two parts of a Fe—Ni—P composite powder 3, 5 were weighed and each part weighed 8 g, wherein the powder had an average particle size of 1.85 micrometers and had Ni and P contents of 29.66% and 1.85% by weight, respectively. 34.17 g of a Fe—N powder 4 was weighed, wherein the Fe—N powder 4 had an average particle size of 225 nanometers and had N content of 9.66% by weight. That is, the amounts of the Fe—Ni—P composite powder 3, 5 and the Fe—N powder 4 were 15.83%*2 and 68.34% of their total amount, respectively. 8 g of the Fe—Ni—P composite powder 5, 34.17 g of the Fe—N powder 4, and 8 g of the Fe—Ni—P composite powder 3 were placed in sequence in a graphite mold 2 with a diameter of 2 centimeters and a height of 6 centimeters. Lower and upper pressing heads 6, 1 were advanced by a distance of 1 centimeter and 2.16 centimeters, respectively, to perform a pre-press forming process under an axial pressure of 20 MPa so as to attain adequate contact between the powder particles. The powder along with the mold 2 was then placed in a furnace cavity to be sintered by using a spark plasma sintering (SPS) technique. An axial pressure of 20 MPa was applied to the powder inside the mold to fix it and then the furnace chamber was vacuumized. The furnace was heated to 812.5° C. at a rate of 184° C./min and was held at that temperature for 1.67 minutes. During this, the upper and lower pressing heads 1, 6 gradually moved toward each other with the proceeding of densifying the powder until inner sides of stop shoulders on the pressing heads 1, 6 abutted end surfaces of the mold. Thereafter, the powder was not subjected to the 20 MPa fixed pressure any more, but rather was subjected to free sintering and final forming in a fixed space. After the hold period, the heating was stopped, and the sintered powder was cooled to room temperature in a vacuum environment with circulating water along with the furnace. Then, the sample was removed from the furnace, and the graphite remaining thereon was removed to produce smooth surfaces. Thereafter, an appropriate amount of liquid nitrogen was taken and its temperature was adjusted to minus 50° C. (−50° C.) with ethyl alcohol. The sample was put into the liquid nitrogen at −50° C. for 15 minutes, and was then removed therefrom to be allowed to return to room temperature. During this, the sample was subjected to a phase transition from γ-[Fe, Ni] to α-[Fe, Ni]. The resulting sample had an intermediate layer 11 of porous iron with a porosity of about 35% and two dense surface layers 7, 9 of a Fe—Ni—P alloy with a porosity of about 10%, and had been reinforced through deep cryogenic treatment. Upon examination, no crack was found in the sample subjected to the deep cryogenic treatment. It was also found that about 90% of the γ-[Fe, Ni] had been transformed to the α-[Fe, Ni] and the hardness of the surface layers had been increased to 370 HV0.1 from 250 HV0.1.

Example 7

With reference to FIG. 3-*c*, two parts of a Fe—Ni—P composite powder 3, 5 were weighed and each part weighed 7.5 g, wherein the powder had an average particle size of 2 micrometers and had Ni and P contents of 30% and 2% by weight, respectively. 35 g of a Fe—N powder 4 was weighed, wherein the Fe—N powder 4 had an average particle size of 250 nanometers and had N content of 10% by weight. That is, the amounts of the Fe—Ni—P composite powder 3, 5 and the Fe—N powder 4 were 15%*2 and 70% of their total amount, respectively. 7.5 g of the Fe—Ni—P composite powder 5, 35 g of the Fe—N powder 4, and 7.5 g of the Fe—Ni—P composite powder 3 were placed in sequence in a graphite mold 2 with a diameter of 2 centimeters and a height of 6 centimeters. Lower and upper pressing heads 6, 1 were advanced by a distance of 1 centimeter and 2 centimeters, respectively, to perform a pre-press forming process under an axial pressure of 20 MPa so as to attain adequate contact between the powder particles. The powder along with the mold 2 was then placed in a furnace cavity to be sintered by using a spark plasma sintering (SPS) technique. An axial pressure of 20 MPa was applied to the powder inside the mold to fix it and then the furnace chamber was vacuumized. The furnace was heated to 800° C. at a rate of 200° C./min and was held at that temperature for 1 minute. During this, the upper and lower pressing heads 1, 6 gradually moved toward each other with the proceeding of densifying the powder until inner sides of stop shoulders on the pressing heads 1, 6 abutted end surfaces of the mold. Thereafter, the powder was not subjected to the 20 MPa fixed pressure any more, but rather was subjected to free sintering and final forming in a fixed space. After the hold period, the heating was stopped, and the sintered powder was cooled to room temperature in a vacuum environment with circulating water along with the furnace. Then, the sample was removed from the furnace, and the graphite remaining thereon was removed to produce smooth surfaces. Thereafter, an appropriate amount of liquid nitrogen was taken and its temperature was adjusted to minus 20° C. (−20° C.) with ethyl alcohol. The sample was put into the liquid nitrogen at −20° C. for 15 minutes, and was then removed therefrom to be allowed to return to room temperature. During this, the sample was subjected to a phase transition from γ-[Fe, Ni] to α-[Fe, Ni]. The resulting sample had an intermediate layer 11 of porous iron with a porosity of about 39% and two dense surface layers 7, 9 of a Fe—Ni—P alloy with a porosity of about 10%, and had been reinforced through deep cryogenic treatment. Upon examination, no crack was found in the sample subjected to the deep cryogenic treatment. It was also found that about 30% of the γ-[Fe, Ni] had been transformed to the α-[Fe, Ni] and the hardness of the surface layers had been increased to 310 HV0.1 from 250 HV0.1.

REFERENCE NUMERAL LIST

1 Upper pressing head
2 Graphite mold
3 Fe—Ni—P composite powder
4 Fe—N powder
5 Fe—Ni—P composite powder
6 Lower pressing head
7 Fe—Ni—P alloy
8 Porous iron (with a low porosity)
9 Fe—Ni—P alloy
10 Porous iron (with a medium porosity)
11 Porous iron (with a high porosity)

What is claimed is:

1. A method of making an iron matrix composite, comprising:

weighing two parts of a Fe—Ni—P composite powder with a particle size of about 1 micrometer to about 2 micrometers and one part of a Fe—N powder with a particle size of about 100 nanometers to about 250 nanometers, wherein each part of the Fe—Ni—P composite powder is about 15% to about 20% by weight of the total amount of the powder, and wherein the Fe—N powder is about 60% to about 70% by weight of the total amount of the powder;

placing one of the two parts of the Fe—Ni—P composite powder, the one part of the Fe—N powder, and the other one of the two parts of the Fe—Ni—P composite powder in a graphite mold (2) in sequence to be subjected to a pre-press forming process under an axial pressure of 20 MPa, so as to form a composite cylinder with two ends formed by the Fe—Ni—P composite powder and a middle section therebetween formed by the Fe—N powder; and placing the preformed cylinder along with the mold (2) in a spark plasma sintering furnace to be sintered in a vacuum environment, wherein the sintering process produces a Fe—Ni—P alloy having a metastable gamma-phase structure, i.e., a face-centered cubic structure; and wherein the axial pressure is applied from two opposing directions, and wherein an upper pressing head (1) has an advance length of about 2 centimeters to about 3 centimeters inside the mold, and a lower pressing head (6) has an advance length of about one centimeter thereinside, and wherein during the sintering process, the upper and lower pressing heads (1, 6) positioned at either end of the mold (2) move toward each other in an axial direction until stop shoulders on the upper and lower pressing heads (1, 6) abut end surfaces of the two ends of the mold (2), such that a space of about 6.28 cubic centimeters to about 9.42 cubic centimeters is left in a cavity of the mold (2) for free sintering and final forming of the powder and the resulting composite has an intermediate layer with a porosity of about 14% to about 39%.

2. The method of claim 1, wherein the graphite mold (2) is in the form of a hollow cylinder.

3. The method of claim 1, wherein each of the upper and lower pressing heads (1, 6) is T-shaped and in the form of a cylinder with a stop shoulder.

4. The method of claim 1, wherein the Fe—Ni—P composite powder used has a particle size of about 1 micrometer to about 2 micrometers, and has Ni and P contents of about 28% to about 30% and about 1.5% to about 2% by weight, respectively; and wherein the Fe—N powder used has an N content of about 8% to about 10% by weight.

5. The method of claim 1, wherein the sintering process is performed through heating the furnace up to a temperature of about 800° C. to about 875° C. at a temperature rising rate of about 100° C./min to about 200° C./min and holding at that temperature for about 1 minute to about 5 minutes.

6. The method of claim 1, wherein the composite comprises an intermediate layer of porous iron, which has an average pore size of around one micrometer and provides shock absorbing and damping properties, and wherein a Fe—Ni—P alloy is disposed on either side of the intermediate layer and has high Ni and P contents.

* * * * *